US007230596B2

(12) United States Patent
Guo et al.

(10) Patent No.: US 7,230,596 B2
(45) Date of Patent: Jun. 12, 2007

(54) ACTIVE ORGANIC ELECTROLUMINESCENCE DISPLAY PANEL MODULE AND DRIVING MODULE THEREOF

(75) Inventors: Hong-Ru Guo, Tainan (TW); Keng-Chu Lin, Tainan (TW); Chen-Chung Yang, Tainan (TW)

(73) Assignee: Chi Mei Optoelectronics Corporation (TW)

( * ) Notice: Subject to any disclaimer, the term of this patent is extended or adjusted under 35 U.S.C. 154(b) by 111 days.

(21) Appl. No.: 11/061,333

(22) Filed: Feb. 18, 2005

(65) Prior Publication Data

US 2006/0082523 A1 Apr. 20, 2006

(30) Foreign Application Priority Data

Oct. 18, 2004 (TW) ..... 93131538 A

(51) Int. Cl.
*G09G 3/30* (2006.01)

(52) U.S. Cl. ..... 345/82; 345/204

(58) Field of Classification Search ..... 315/169.1, 315/169.2, 169.3; 345/76, 690
See application file for complete search history.

(56) References Cited

U.S. PATENT DOCUMENTS

2005/0007392 A1* 1/2005 Kasai et al. ..... 345/690

* cited by examiner

*Primary Examiner*—David Vu
(74) *Attorney, Agent, or Firm*—Trop, Pruner & Hu, P.C.

(57) ABSTRACT

An active organic electroluminescence display panel module comprising a substrate, a plurality of organic light-emitting devices, a light-emitting device driving unit and a temperature sensor unit are provided. The light-emitting device driving unit is electrically connected to the organic light-emitting devices for driving them. The temperature sensor unit is disposed on the substrate for sensing the temperature of the active organic electroluminescence display panel. The temperature sensor unit is also electrically connected to the light-emitting device driving unit for providing a signal to the light-emitting device driving unit in response to the sensed temperature. Accordingly, the light-emitting device driving unit can adjust the driving voltage of the organic light-emitting devices in the active organic electroluminescence display panel to reduce overall power consumption and provide an accurate grayscale to improve the quality of displayed images.

26 Claims, 7 Drawing Sheets

ACTIVE ORGANIC ELECTROLUMINESCENCE DISPLAY PANEL MODULE AND DRIVING MODULE THEREOF

BACKGROUND OF THE INVENTION

1. Field of the Invention

The present invention relates to a display panel and driving module thereof. More particularly, the present invention relates to an active organic electroluminescence display panel module and driving module thereof.

2. Description of the Related Art

With the many innovations in the process of fabricating semiconductor devices and display devices, multimedia systems proliferate into every corners of the world. For display devices, flat panel displays have become one of the mainstream products due to its high quality display images, efficient spatial utilization, energy efficiency and radiation-free illumination. The so-called flat panel displays actually refers to a group of displays including liquid crystal display (LCD), organic electroluminescence display and plasma display panel (PDP). An organic electroluminescence display device comprises an array of self-emissive pixels. The advantages of an organic electroluminescence display are many, including no particular viewing angle limitation, a low fabricating cost, a high response speed (a hundred folds that of the liquid crystal display), a low power consumption and a large operating temperature range. Furthermore, the organic electroluminescence display can be driven by a Direct Current (DC) and miniaturized with other hardware equipment. Hence, organic electroluminescence display products have great development potential in the future. In particular, the organic electroluminescence display is suitable for displaying information in multimedia systems.

In general, an organic electroluminescence display can be classified as an active or a passive organic electroluminescence display according to the method of driving its internal light-emitting devices. Because the light-emitting efficiency and life span of passively driven devices will drop significantly with an increase in the size and resolution of the display device, most low-grade organic electroluminescence displays are passively driven while most high-grade organic electroluminescence displays are actively driven.

The light-emitting devices inside an organic electroluminescence are normally constructed using organic light-emitting diodes. In general, the voltage-current characteristic of an organic light-emitting diode is affected by temperature when the temperature is high. FIG. 1 is a graph showing the voltage-current relationship characteristics for an organic light-emitting diode. In FIG. 1, curve C1 indicates the voltage-current loading line when the organic light-emitting diode is at the room temperature while curve C2 indicates the voltage-current loading line when the organic light-emitting diode is heated to a temperature higher than the room temperature. At a constant current, the voltage needed to drive the organic light-emitting diode drops from $V_{D1}$ to $V_{D2}$ when the temperature is increased as shown in FIG. 1. Therefore, if the input voltage for driving the organic electroluminescence display is not adjusted accordingly, those devices within the display will consume extra power unnecessarily.

SUMMARY OF THE INVENTION

Accordingly, at least one objective of the present invention is to provide an active organic electroluminescence display panel module and a driving module for an organic electroluminescence display such that the driving voltage of the light-emitting devices and the input signal of the gray-scale can be adjusted according to the temperatures. Hence, power wastage is minimized and the quality of images on the display panel is improved.

To achieve these and other advantages and in accordance with the purpose of the invention, as embodied and broadly described herein, the invention provides an active organic electroluminescence display panel module. The active organic electroluminescence display panel module comprising a substrate, a plurality of organic light-emitting devices, a light-emitting device driving unit and a temperature sensor unit are provided. The organic light-emitting devices and the light-emitting device driving unit are disposed on the substrate. The light-emitting device driving unit is electrically connected to the organic light-emitting devices for driving them. The temperature sensor unit is disposed on the substrate and electrically connected to the light-emitting device driving unit for sensing the temperature of the substrate.

The present invention also provides a driving module for an active organic electroluminescence display panel disposed on the periphery of the active organic electroluminescence display panel. The driving module comprises a panel-driving unit and a temperature sensor unit. The panel-driving unit is electrically connected to the organic electroluminescence display panel and the temperature sensor unit is electrically connected to the panel-driving unit. The temperature sensor unit is used for sensing the surrounding temperature.

The present invention further provides an active organic electroluminescence display panel module. The active organic electroluminescence display panel module mainly comprises a substrate, a plurality of organic light-emitting devices, a light-emitting device driving unit and a plurality of temperature sensor units. The substrate is divided into a plurality of pixel areas. The organic light-emitting devices and the light-emitting driving unit are disposed on the substrate. Furthermore, an organic light-emitting device is disposed within each pixel area. The light-emitting device driving unit is connected to the organic light-emitting devices for driving them. Each temperature sensor unit is disposed within a pixel area on the substrate. The temperature sensor units are connected to the light-emitting device driving unit for detecting the temperature inside each pixel area.

According to the embodiment of the present invention, the organic light-emitting device is an organic light-emitting diode and the substrate is fabricated using a material such as glass or plastic, for example.

According to the embodiment of the present invention, the light-emitting device driving unit further comprises a plurality of scan lines, a plurality of data lines and a plurality of thin film transistors. The scan lines and the data lines are disposed on the substrate and laid over each other alternately. The areas bounded by the scan lines and the data lines are the pixel areas of the active organic electroluminescence display panel. The organic light-emitting devices and the thin film transistors are disposed inside these pixel areas. In one embodiment, two thin film transistors are disposed inside each pixel area.

According to one embodiment of the present invention, the temperature sensor unit further comprises a temperature sensor device and a temperature correction circuit. The temperature sensor device is used for measuring the temperature of the substrate. The temperature sensor device is connected to the temperature correction circuit. In fact, the temperature correction circuit is disposed between the temperature sensor device and the light-emitting device driving unit for outputting a signal to the light-emitting device driving unit according to the temperature detected through the temperature sensor device.

According to one embodiment of the present invention, the active organic electroluminescence display panel module further comprises an image input interface connected to the light-emitting device driving unit. In another embodiment, the active organic electroluminescence display panel module further comprises a signal processing circuit connected to the temperature sensor unit and the light-emitting device driving unit for processing the signal before submitting to the light-emitting device driving unit. In particular, the signal processing circuit comprises a grayscale calibration unit. The grayscale calibration unit is connected to the temperature sensor unit and the light-emitting device driving unit for receiving the signal from the temperature sensor unit and outputting a grayscale calibrated signal to the light-emitting device driving unit according to the received signal.

According to one embodiment of the present invention, the panel-driving unit comprises a scan line driving device and a data line driving device. Both the scan line driving device and the data line driving device is connected to the organic electroluminescence display panel.

In the present invention, a temperature sensor device is disposed on the active organic electroluminescence display panel or the peripheral circuits of the active organic electroluminescence display to detect the change in temperature during device operation. The measured temperature is then fed back to the driving circuit so that the driving circuit can adjust the output voltage to the device according to the actual temperature. Ultimately, less power is wasted through the device.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

In FIG. 4, the curves $C_1$ and $C_2$ represent the load line when the organic light-emitting device 204 is at a different temperature.

In FIG. 6, the curves $C_1$ and $C_2$ represent the load line when the organic light-emitting device 204 is at a different temperature.

DESCRIPTION OF THE PREFERRED EMBODIMENTS

Figure 1:
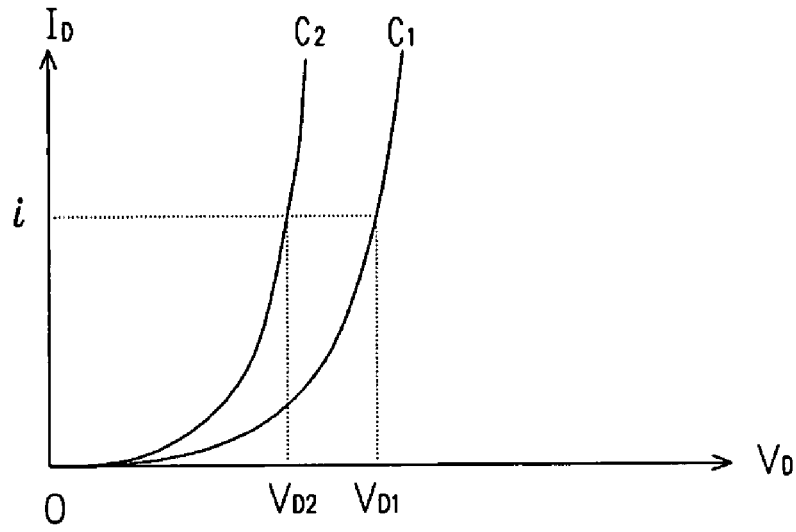
FIG. 1 (PRIOR ART)
FIG. 1 is a graph showing the voltage-current relationship for an organic light-emitting diode.

Reference will now be made in detail to the present preferred embodiments of the invention, examples of which are illustrated in the accompanying drawings. Wherever possible, the same reference numbers are used in the drawings and the description to refer to the same or like parts.

Figure 2A:
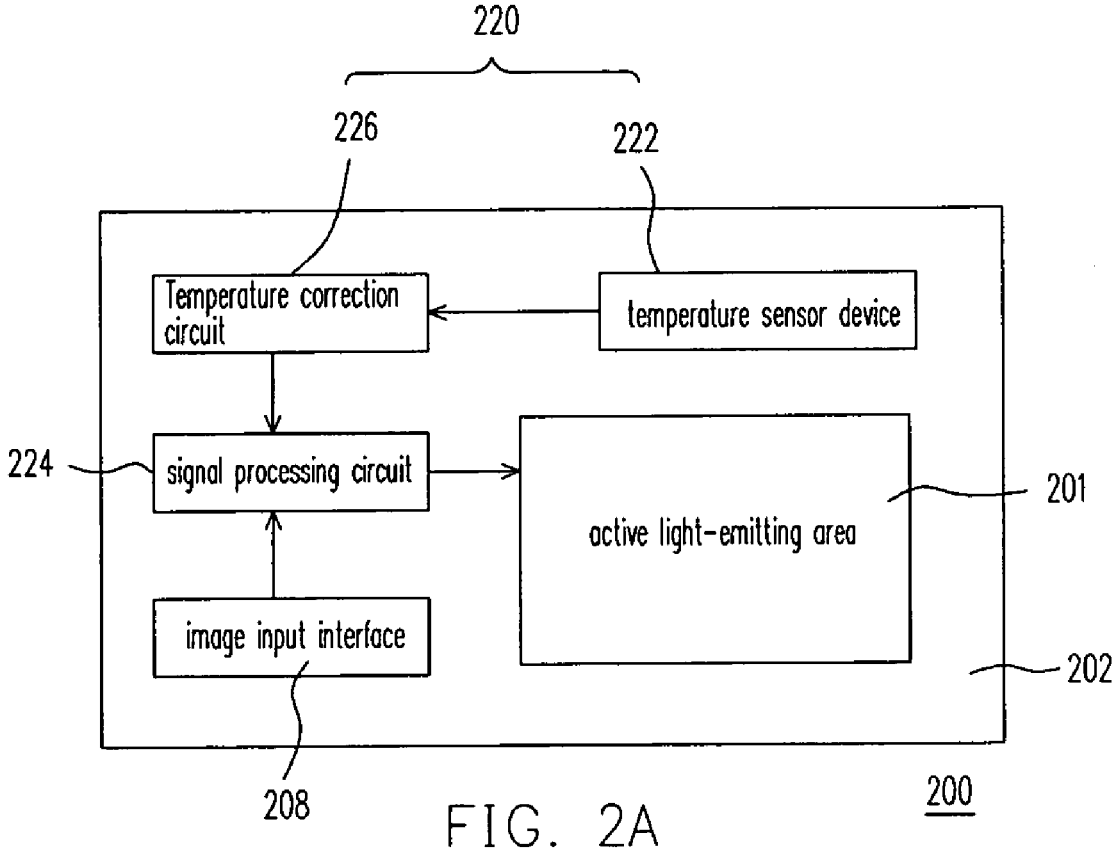
FIG. 2A is a block diagram of one type of active organic electroluminescence display panel module according to one preferred embodiment of the present invention.
Figure 2B:
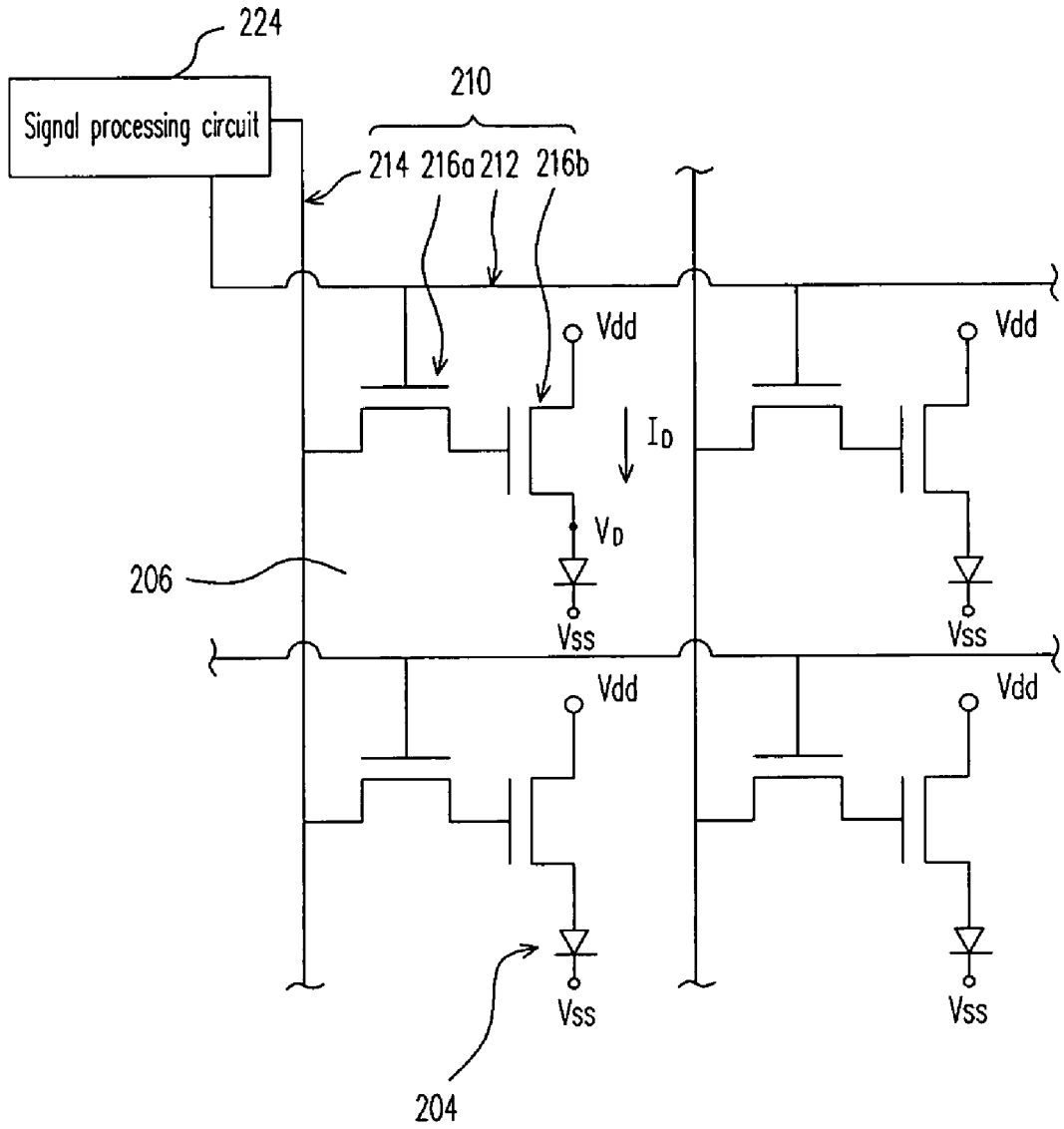
FIG. 2B is a circuit diagram showing a portion of the circuit in the active light-emitting area in the active organic electroluminescence display panel module in FIG. 2A.

FIG. 2A is a block diagram of one type of active organic electroluminescence display panel module according to one preferred embodiment of the present invention. FIG. 2B is a circuit diagram showing a portion of the circuit in the active light-emitting area in the active organic electroluminescence display panel module in FIG. 2A. As shown in FIGS. 2A and 2B, the active organic electroluminescence display panel module 200 comprises a substrate 202, an organic light-emitting device 204, a light-emitting device driving unit 210 and a temperature sensor unit 220. The organic light-emitting device 204 and the light-emitting device driving circuit 210 are disposed within the active light-emitting area 201 of the substrate 202. The substrate 202 is fabricated using a material such as glass or plastic, for example. The light-emitting device driving unit 210 is electrically connected to the organic light-emitting device 204 for driving the organic light-emitting device 204. In one preferred embodiment, the light-emitting device driving unit 210 further comprises a plurality of scan lines 212, a plurality of data lines 214 and a plurality of thin film transistors 216. The data lines 214 and the scan lines 212 are disposed on the substrate 202 crossing each other perpendicularly to form a plurality of pixel areas 206 as shown in FIG. 2B. Furthermore, each pixel area 206 includes a controlling thin film transistor 216*a*, a driving thin film transistor 216*b* and an organic light-emitting device 204. The source/drain terminal of the driving thin film transistor 216*b* electrically connected to the organic light-emitting device 204 is applied voltage of $V_{dd}$. Here, the organic light-emitting device 204 is an organic light-emitting diode and the controlling thin film transistor 216*a* and the driving thin film transistor 216*b* are n-type thin film transistors or p-type thin film transistors, for example.

The temperature sensor unit 220 is electrically connected to the light-emitting device driving unit 210 for sensing the operating temperature of the organic electroluminescence display panel module 200 and outputting a signal to the light-emitting device driving unit 210 according to the sensed temperature so that the light-emitting device driving unit 210 can adjust the voltage supplied to the device according to the current temperature. In one preferred embodiment, the temperature sensor unit 220 may comprises a temperature sensor device 222 and a temperature correction circuit 226. The temperature correction circuit 226 is electrically connected to the temperature sensor device 222. Furthermore, the organic electroluminescence display panel module 200 may include a signal processing circuit 224 between the temperature correction circuit 226 and the light-emitting device driving unit 210 and electrically connected to them.

After the temperature sensor device 222 has sensed the operating temperature of the organic electroluminescence display panel module 200, the temperature correction circuit 226 can output a signal to the signal processing circuit 224 according to the temperature sensed by the temperature sensor device 222. Thereafter, according to the output signal from the temperature correction circuit 226, the signal processing circuit 224 computes the driving voltage necessary for driving the device under this temperature. Then, the computed result is output to the light-emitting device driving unit 210 for providing a suitable voltage to drive the organic light-emitting device 204 and prevent the light-emitting device driving unit 210 from outputting too high a driving voltage leading to a waste of power consumption. In detail, when the temperature inside the organic electroluminescence display panel module 200 rises, the signal processing circuit 224 will output a signal to the light-emitting device driving unit 210 according to the temperature sensed by the temperature sensor device 222. Thus, at a constant driving current condition, the value of the voltage $V_{dd}$ applied to the source/drain terminal of the driving thin film transistor 216*b* or the value of the voltage source $V_{ss}$ coupled to the organic light-emitting device 204 will drop. Consequently, overall power consumption of the device is reduced.

In addition, in one preferred embodiment, the organic electroluminescence display panel module of the present invention may include an image input interface 208 electrically connected to the light-emitting device driving unit 210. The image input interface 208 outputs image signal to the light-emitting device driving unit 210 so that the panel can display an image corresponding to the image signal as shown in FIG. 2A.

Figure 3:
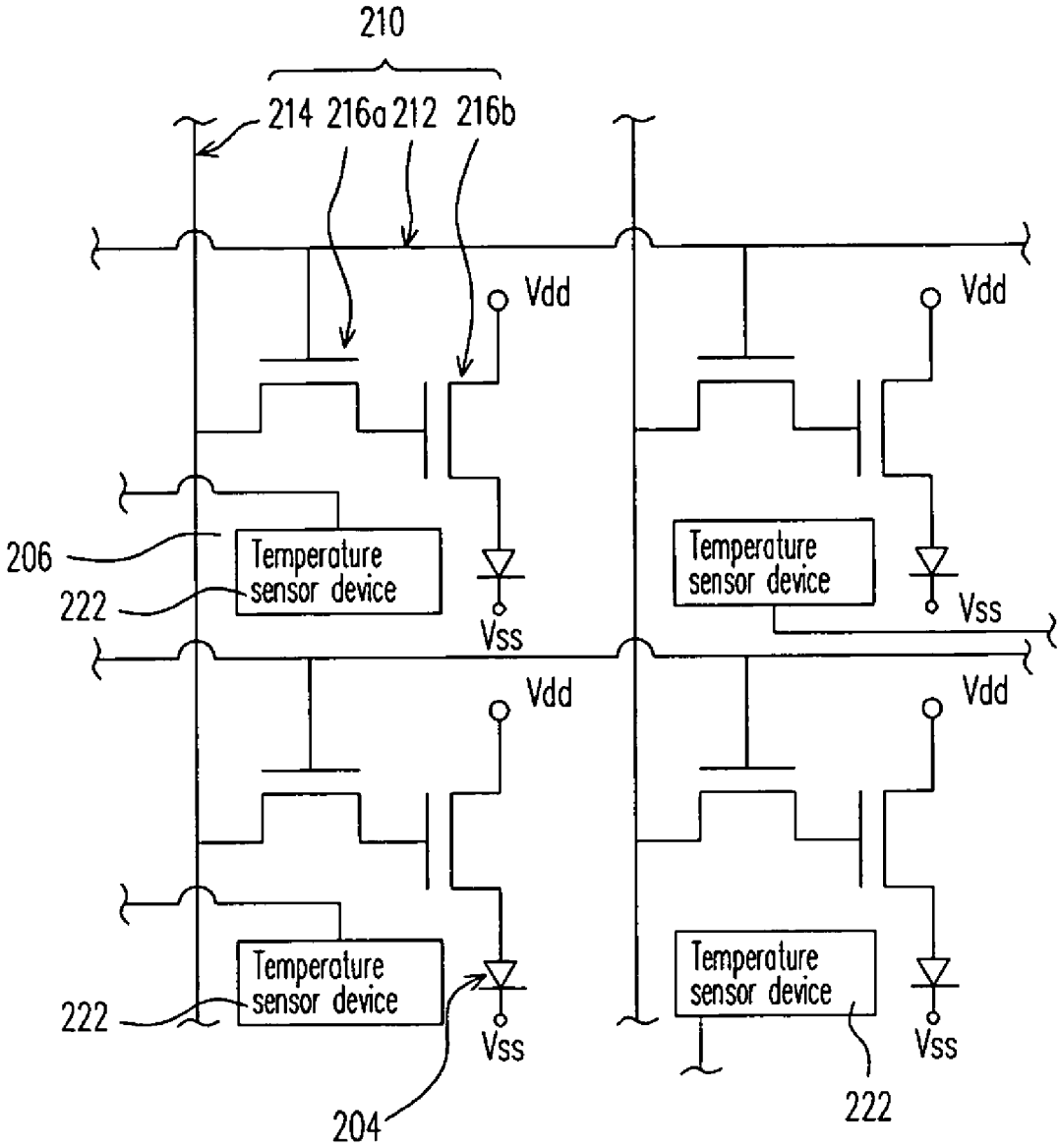
FIG. 3 is a circuit diagram showing a portion of the circuit in the active light-emitting area in another active organic electroluminescence display panel module according to another preferred embodiment of the present invention.

In another embodiment of the present invention, each pixel area 206 may enclose a temperature sensor device 222 (as shown in FIG. 3) so that the temperature within each pixel area 206 can be detected. According to the temperature inside each pixel area 206, the light-emitting device driving unit 210 adjusts the driving voltage $V_{dd}$ inside each pixel area 206 or the organic light-emitting device 204 coupled voltage source $V_{ss}$ so that the power consumption of the device is further reduced.

Figure 4:
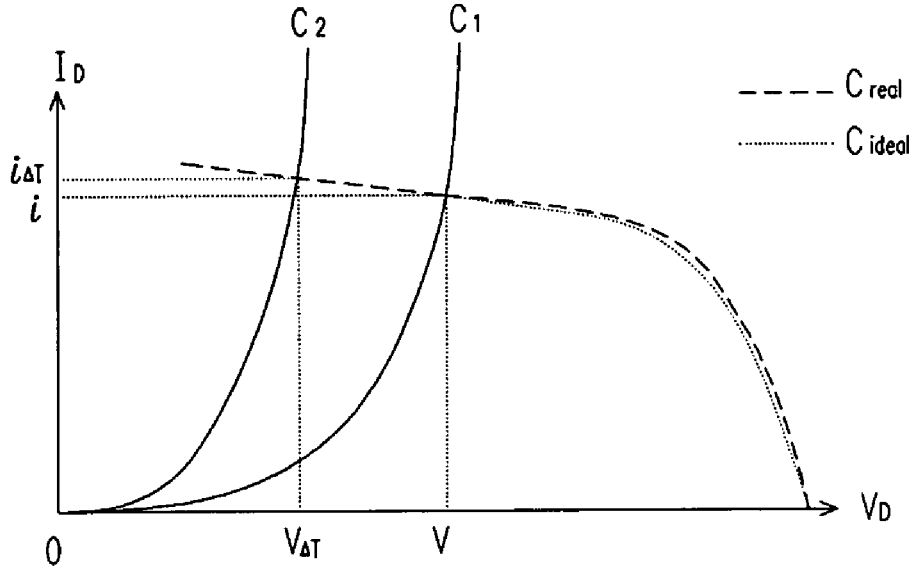
FIG. 4 is a graph showing the ideal curve relation and the real curve relation between the drain current $I_D$ and the voltage $V_D$ of a driving thin film transistor 216*b* according to one embodiment of the present invention.

FIG. 4 is a graph showing the ideal curve relation and the real curve relation between the drain current $I_D$ and the voltage $V_D$ of a driving thin film transistor 216*b* according to one embodiment of the present invention. In FIG. 4, the curves $C_1$ and $C_2$ represent the loading line when the organic light-emitting device 204 is at a different temperature. As shown in FIGS. 2B and 4, when the temperature of the organic light-emitting device 204 rises, the loading line shifts from $C_1$ to $C_2$. In other words, at a constant driving current i, the driving voltage $V_D$ of the organic light-emitting device 204 drops from V to $V_{\Delta T}$. Therefore, in this invention, the voltage value $V_{dd}$ applied to the source/drain terminal of the driving thin film transistor 216*b* may drop at this moment so that the driving voltage of the organic light-emitting device 204 drops to $V_{\Delta T}$. Hence, overall power consumption of the panel module is reduced.

However, in real conditions, the thin film transistor will have channel modulation that leads to a change in the saturation current of the thin film transistor 216. As shown in FIGS. 2B and 4, using the driving thin film transistor 216*b* as an example, as the temperature rises, its saturated current (the driving current $I_D$ of the organic light-emitting device 204) will increase from current i to current $i_{\Delta T}$. Meanwhile, the drain current $I_D$ and the voltage $V_D$ relation curve will shift from curve $C_{ideal}$ upward to curve $C_{real}$. The change in the driving current $I_D$ of the organic light-emitting device 204 with temperature will lead to image grayscale error problem, thereby affecting the quality of the image displayed on the panel.

To resolve the aforementioned problem, one must shift the difference between source/drain voltage and gate voltage $V_{SG}$ and make the drain current $I_D$ relation curve of the driving thin film transistor 216*b* becomes downward. In other words, if the original driving current of the organic light-emitting device 204 is to be maintained after the temperature has risen, then the difference between source/drain voltage and gate voltage $V_{SG}$ of the driving thin film transistor 216*b* must be reduced. One of the methods is to reduce the voltage value $V_{dd}$ applied to the source/drain terminal of the driving thin film transistor 216*b* so that the current driving the organic light-emitting device 204 drops from $i_{\Delta T}$ to i. However, other methods can be used to reduce the driving current of the organic light-emitting device 204. In the following, another embodiment of the present invention is used to illustrate one other method.

Figure 5A:
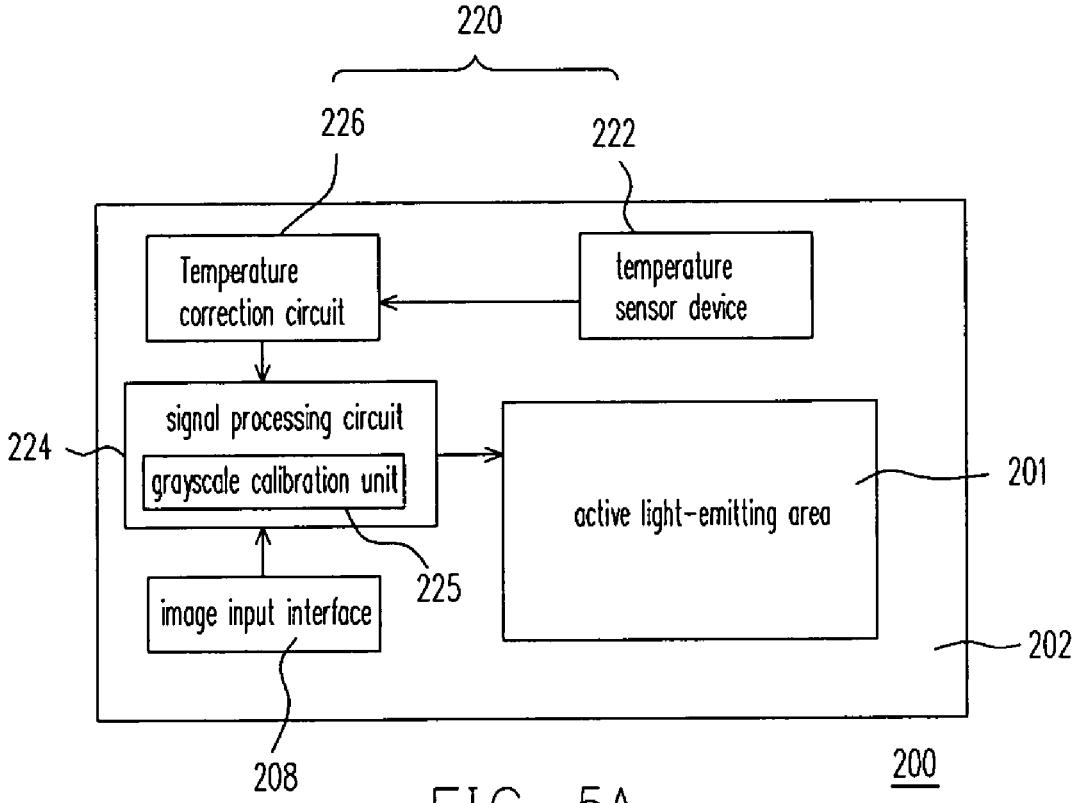
FIG. 5A is a block diagram of one type of active organic electroluminescence display panel module according to another preferred embodiment of the present invention.
Figure 5B:
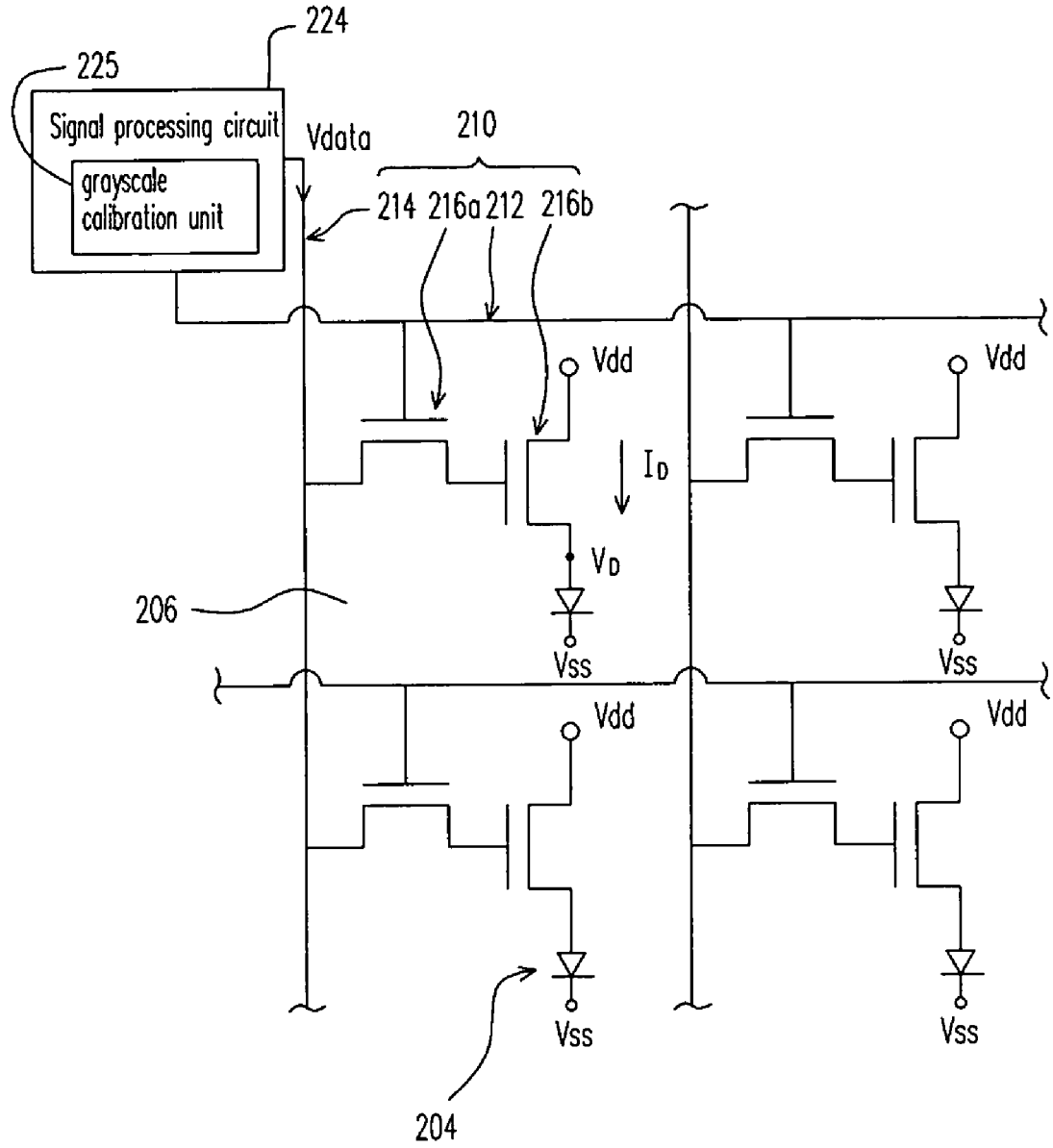
FIG. 5B is a circuit diagram showing a portion of the circuit in the active light-emitting area in the active organic electroluminescence display panel module in FIG. 5A.

FIG. 5A is a block diagram of one type of active organic electroluminescence display panel module according to another preferred embodiment of the present invention. FIG. 5B is a circuit diagram showing a portion of the circuit in the active light-emitting area in the active organic electroluminescence display panel module in FIG. 5A. As shown in FIGS. 5A and 5B, to resolve the aforementioned problem of grayscale error problem caused by the change in driving current, the present invention sets up a grayscale calibration unit 225 inside the signal processing circuit 224 for receiving the output signal from the temperature sensor unit 220. According to the received signal, the grayscale calibration unit 225 adjusts the grayscale of the signal outputting to the light-emitting device driving unit 210. The grayscale calibration unit 225 changes the signal voltage $V_{data}$ of the input data line 214 for changing driving current of the organic light-emitting device 204.

Figure 6:
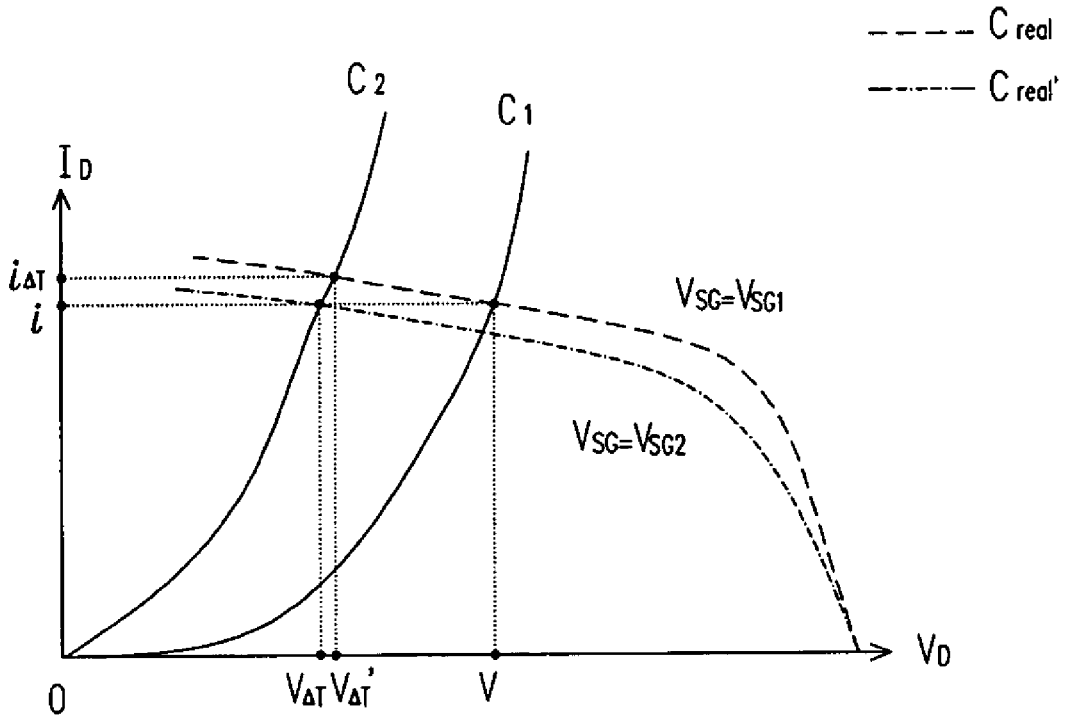
FIG. 6 is a graph showing the real curve relation between the drain current $I_D$ and the voltage $V_D$ of a driving thin film transistor 216*b* according to one embodiment of the present invention.

FIG. 6 is a graph showing the actual curve relation between the drain current $I_D$ and the voltage $V_D$ of a driving thin film transistor 216*b* according to another embodiment of the present invention. As shown in FIGS. 5B and 6, the curve $C_{real}$ shows the relation between the drain current $I_D$ and the voltage $V_D$ when the difference between source/drain voltage and gate voltage of the driving thin film transistor 216*b* is $V_{SG1}$. The curve $C_{real}$, shows the relation between the drain current $I_D$ and the voltage $V_D$ when the difference between source/drain voltage and gate voltage of the driving thin film transistor 216*b* is $V_{SG2}$. Here, the voltage value of $V_{SG1}$ is greater than the voltage value of $V_{SG2}$.

shown in FIGS. 5B and 6, as the temperature of the organic light-emitting device 204 rises, its loading line shift to the left from curve $C_1$ to curve $C_2$, the driving current $I_D$ of the organic light-emitting device 204 increases from current i to current $i_{\Delta T}$ and the driving voltage $V_D$ of the organic light-emitting device 204 decreases from voltage V to voltage $V_{\Delta T}'$. At this moment, the signal voltage $V_{data}$ input to the data line 214 can be increased through the grayscale calibration unit 225 to increase the gate voltage of the driving thin film transistor 216*b*. As a result, the difference between source/drain voltage and gate voltage of the driving thin film transistor 216*b* drops from $V_{SG1}$ to $V_{SG2}$.

According to FIG. 6, after the dropping of the difference between source/drain voltage and gate voltage of the driving thin film transistor 216*b* from $V_{SG1}$ to $V_{SG2}$, the current $I_D$ of the organic light-emitting device 204 drops back to i and the driving voltage $V_D$ of the organic light-emitting device 204 drops to $V_{\Delta T}$. Therefore, aside from reducing the voltage value $V_{dd}$ applied to the source/drain terminal of the driving thin film transistor 216*b*, the present invention also provides a grayscale calibration unit to control the signal voltage $V_{data}$ and prevent image grayscale error problem due to a variation of brightness with temperature in the display process of the organic light-emitting device 204.

In the aforementioned embodiment, the temperature sensor unit is disposed on the organic electroluminescence display panel. However, the present invention also allows the temperature sensor unit to be disposed in areas outside the organic electroluminescence display panel. The following embodiment is used to illustrate this.

Figure 7:
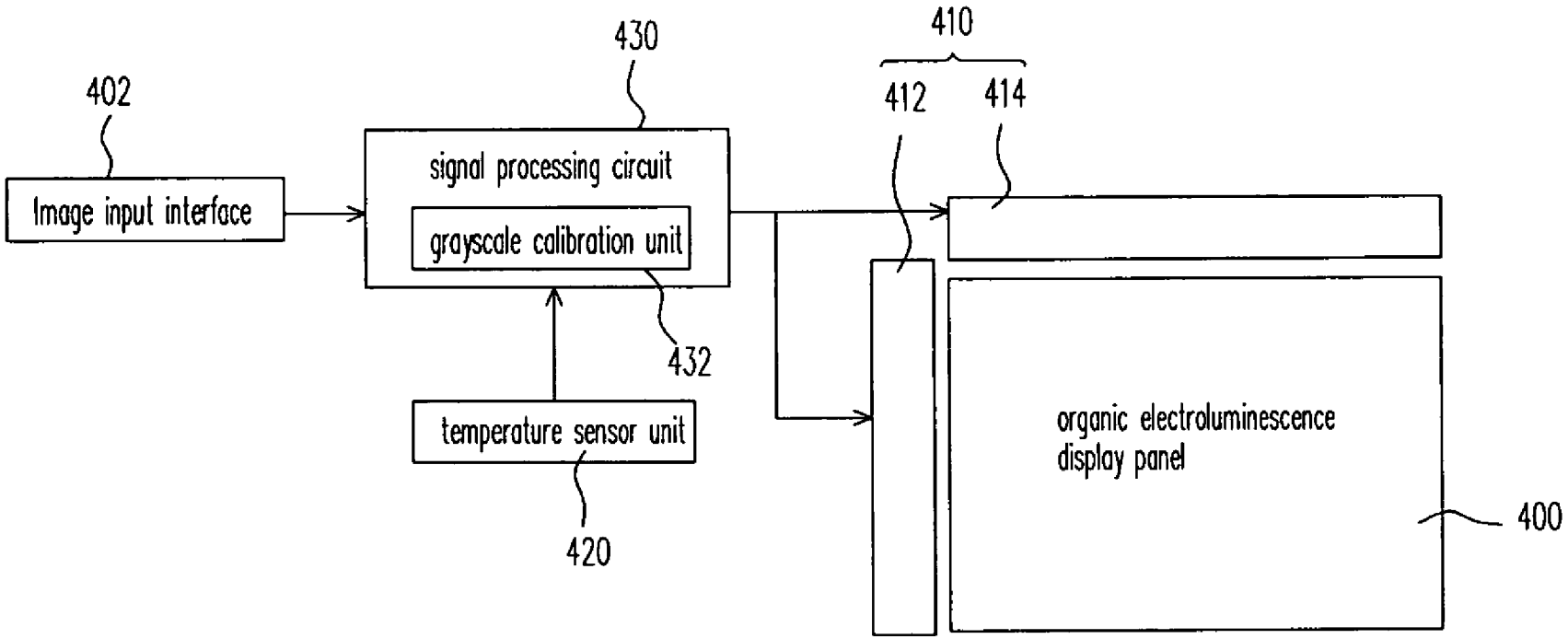
FIG. 7 is a block diagram showing the driving module of an organic electroluminescence display panel according to one embodiment of the present invention.

FIG. 7 is a block diagram showing the driving module of an organic electroluminescence display panel according to one embodiment of the present invention. As shown in FIG. 7, the driving module of the organic electroluminescence display panel mainly comprises a panel-driving unit 410 and a temperature sensor unit 420. The panel-driving unit 410 is disposed on two adjacent sides of the organic electroluminescence display panel 400 and is also electrically connected to the panel 400. The panel-driving unit 410 further comprises a data line driving unit 412 and a scan line driving unit 414 for driving the organic electroluminescence display panel 400 and lighting it up. The temperature sensor unit 420 is electrically connected to the panel-driving unit 410 for outputting a signal to the panel-driving unit 410 according to a sensed temperature so that the panel-driving unit 410 can adjust the driving voltage of the panel according to the current temperature. Hence, overall power consumption of the panel is reduced.

Similarly, in one embodiment of the present invention, the driving module of the organic electroluminescence display panel may further comprise an image input interface 402 and a feedback unit 430 connected to the panel-driving unit 410. The image input interface 402 has a function identical to the aforementioned image input interface 208 and the feedback unit 430 has a function similar to the signal processing circuit 224 in the aforementioned embodiment. Furthermore, the feedback unit 430 may include a grayscale calibration unit 432. According to the change in temperature, the grayscale calibration unit 432 adjusts the grayscale of the input signal to ensure a correct grayscale image and improve the quality of the displayed image.

In the present invention, the temperature sensor unit is disposed on the organic electroluminescence display panel module or the driving module of the organic electroluminescence display panel module. The temperature sensor unit measures the operating temperature of the organic electroluminescence display panel and adjusts the driving voltage of the panel accordingly so as to reduce overall power consumption. For example, according to a set of experimental data of the present invention, an organic light-emitting device at a temperature 25° C. requires 5.3 V to achieve 1.25 mill amperes per centimeter square ($mA/cm^2$) current density. The luminosity is about 100 nit. When the temperature rises to 50° C., the organic light-emitting device requires only 4.77 V to reach a current density of 1.25 $mA/cm^2$. In other words, there is a drop in the driving voltage of the organic light-emitting device by 0.53 V. Using a 7-inch organic electroluminescence display panel having a 480×234 resolution as an example, excess power consumed is about 66.9 mW. That means, if the present invention is applied to a 7-inch organic electroluminescence display panel having a 480×234 resolution, then the driving voltage of the panel module can be lowered 0.53 V to save 66.9 mW of power when the temperature rises to 50° C. Therefore, the present provides an effective means of reducing overall power consumption of the panel.

In addition, when the driving current of the organic light-emitting device changes according to the temperature changes, the present invention, aside from lowering the driving voltage, also allows the voltage value of the input signal to be adjusted through the grayscale calibration unit according to the temperature changes sensed by the temperature sensor unit and returns to the original driving current value of the organic light-emitting device. Using the experimental data of the present invention as an example, 5.3 V of driving voltage and 0.1 microampere (μA) of current is required to drive the organic light-emitting device 204 so that a luminosity of about 1000 nits is produced. At this moment, the difference between source/drain voltage and gate voltage $V_{SG}$ of the driving thin film transistor 216*b* is 5 V, for example. However, when the temperature rises to 50° C., the organic light-emitting device 204 requires a driving voltage of only 4.77 V to reach a luminosity of 1000 nits. If $V_{SG}$ is still maintained at 5 V, then the driving voltage $V_D$ of the organic light-emitting device 204 will drop to 5 V and the driving current $I_D$ will rise from 0.1 microampere to 0.12 microampere, thereby leading to a grayscale error problem. Therefore, if the driving current of the organic light-emitting device 204 has to remain at the 0.1 microampere level, then the voltage $V_{SG}$ needs to be lowered to 4 V. According to the equation $V_{SG}=V_S-V_G=V_{dd}-V_{data}$, if the source/drain voltage $V_S$ of the driving thin film transistor 216*b* is maintained at 8 V and the signal voltage $V_{data}$ input to the data line 214 at 25° C. is 3 V, then, when temperature rises to 50° C., the grayscale calibration unit 225 is needed to adjust the signal voltage $V_{data}$ from 3 V to 4 V so that the voltage $V_{SG}$ drops to 4 V. At this time, the driving voltage of the organic light-emitting device also drops to 4.77 V and the driving current returns to 0.1 microampere. Thus, the present invention provides an effective means of improving image grayscale error problem due to temperature changes in the organic electroluminescence display panel.

In summary, the present invention not only reduces the power consumption of the organic electroluminescence display panel module, but also provides corrections to the grayscale of display image so that overall quality of the pictures is improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An active organic electroluminescence display panel module, comprising:

a substrate;

a first voltage and a second voltage;

a plurality of organic light-emitting devices disposed on the substrate, wherein at least one of the organic light-emitting devices is coupled between the first voltage and the second voltage such that an amount of current passing through the at least one organic light-emitting device is dependent on the first and second voltages;

a light-emitting device driving unit disposed on the substrate and connected to the organic light-emitting devices, the light-emitting device driving unit comprising a plurality of data lines and plurality of scan lines;

a temperature sensor unit disposed on the substrate and connected to the light-emitting device driving unit for sensing a temperature of the active organic electroluminescence display panel module; and a signal processing circuit to adjust at least one of the first and second voltages in response to an output from the temperature sensor unit.

2. The active organic electroluminescence display panel module of claim 1, wherein the organic light-emitting devices comprise organic light-emitting diodes.

3. The active organic electroluminescence display panel module of claim 1, wherein the material constituting the substrate comprises glass or plastic.

4. The active organic electroluminescence display panel module of claim 1, wherein the plurality of scan lines are disposed over the substrate; and the plurality of data lines are disposed over the substrate and crosses the scan lines, wherein the data lines and the scan lines together enclose a plurality of pixel areas such that each organic light-emitting device is disposed within one of the pixel areas; and a plurality of thin film transistors connected to corresponding scan and data lines and disposed within respective pixel areas.

5. The active organic electroluminescence display panel module of claim 4, wherein two of the thin film transistors are disposed within each pixel area.

6. The active organic electroluminescence display panel module of claim 1, wherein the temperature sensor unit further comprising:

a temperature sensor device; and a temperature correction circuit connected to the temperature sensor device, wherein the temperature correction circuit outputs a signal to the signal processing circuit according to the temperature sensed by the temperature sensor device, and wherein the signal processing circuit adjusts at least one of the first and second voltages based on the signal output from the temperature correction circuit.

7. The active organic electroluminescence display panel module of claim 1, further comprising an image input interface connected to the light-emitting device driving unit.

8. A driving module for an active organic electroluminescence display panel disposed on a peripheral region of the active organic electroluminescence display panel, wherein the active organic electroluminescence display panel has a plurality of organic light-emitting devices, the driving module comprising:

a panel-driving unit for connection to the organic electroluminescence display panel, the panel-driving unit to provide a plurality of data lines and a plurality of scan lines to the organic electroluminescence display panel, and the panel-driving unit to further provide first and second voltages to the organic electroluminescence display panel that define an amount of current flowing through at least one of the organic light-emitting devices;

a temperature sensor unit connected to the panel-driving unit for sensing a temperature and outputting a signal to the panel-driving unit according to the sensed temperature; and a signal processing circuit to adjust at least one of the first and second voltages in response to the signal output by the temperature sensor unit.

9. The driving module of claim 8, wherein the panel-driving unit further comprising:

a scan line driving device to provide the plurality of scan lines; and a data line driving device to provide the plurality of scan lines.

10. The driving module of claim 8, further comprising an image input interface connected to the panel-driving unit.

11. An active organic electroluminescence display panel module, comprising:

a substrate having a plurality of pixel areas;

a plurality of organic light-emitting devices disposed on the substrate such that each organic light-emitting device is disposed within one of the pixel areas;

a light-emitting device driving unit disposed on the substrate and connected to the organic light-emitting devices; and a plurality of temperature sensor devices disposed on the substrate such that each temperature sensor device is disposed inside one of the pixel areas and connected to the light-emitting device driving unit for sensing a temperature from each pixel area.

12. The active organic electroluminescence display panel module of claim 11, wherein the organic light-emitting devices comprise organic light-emitting diodes.

13. The active organic electroluminescence display panel module of claim 11, wherein the material constituting the substrate comprises glass or plastics.

14. The active organic electroluminescence display panel module of claim 11, wherein the light-emitting device driving unit further comprising:

a plurality of scan lines disposed on the substrate;

a plurality of data lines disposed on the substrate, wherein the data lines cross over the scan lines such that the data lines and the scan lines together form the plurality of pixel areas; and a plurality of thin film transistors disposed within the pixel areas.

15. The active organic electroluminescence display panel module of claim 14, wherein two of the thin film transistors are disposed within each pixel area.

16. The active organic electroluminescence display panel module of claim 11, further comprising a signal processing circuit connected to the temperature sensor devices and the light-emitting device driving unit for processing the signal intended for inputting into the light-emitting device driving unit.

17. The active organic electroluminescence display panel module of claim 16, wherein the signal processing unit further comprises a grayscale calibration unit for receiving a signal from each temperature sensor device and outputting a grayscale corrected signal to the light-emitting device driving unit according to the signals provided by various temperature sensor devices.

18. The active organic electroluminescence display panel module of claim 11, further comprising a temperature correction circuit connected to the temperature sensor devices and the light-emitting device driving unit for outputting a signal to the light-emitting device driving unit according to the sensed temperature of the temperature sensor devices.

19. The active organic electroluminescence display panel module of claim 11, further comprising an image input interface connected to the light-emitting device driving unit.

20. The active organic electroluminescence display panel module of claim 1, wherein the first and second voltages are different from the plurality of scan lines and data lines.

21. The active organic electroluminescence display panel module of claim 1, wherein the first voltage comprises a Vdd voltage, and the second voltage comprises a Vss voltage.

22. The active organic electroluminescence display panel module of claim 1, further comprising pixel areas defined by corresponding scan lines and data lines, wherein the at least one organic light-emitting device is part of one of the pixel areas, wherein the one pixel area further contains a transistor connected between the first voltage and one side of the at least one organic light-emitting device, and wherein another side of the at least one organic light-emitting device is connected to the second voltage.

23. The active organic electroluminescence display panel module of claim 1, wherein the signal processing circuit adjusts at least one of the first and second voltages in response to the output of the temperature sensor unit without adjusting signals in the plurality of data lines.

24. The active organic electroluminescence display panel module of claim 1, wherein the plurality of organic light-emitting devices are connected between the first and second voltages.

25. The driving module of claim 8, wherein the active organic electroluminescence display panel module further comprises pixel areas defined by corresponding scan lines and data lines, wherein the at least one organic light-emitting device is part of one of the pixel areas, wherein the one pixel area further contains a transistor connected between the first voltage and one side of the at least one organic light-emitting device, and wherein another side of the at least one organic light-emitting device is connected to the second voltage.

26. The driving module of claim 8, wherein the first voltage comprises a Vdd voltage and the second voltage comprises a Vss voltage.

* * * * *